US008544959B2

(12) United States Patent
Mackert

(10) Patent No.: US 8,544,959 B2
(45) Date of Patent: Oct. 1, 2013

(54) FURNITURE

(75) Inventor: Michael Mackert, Rüthen (DE)

(73) Assignee: Kintec-Solution GmbH, Rietberg (DE)

( * ) Notice: Subject to any disclaimer, the term of this patent is extended or adjusted under 35 U.S.C. 154(b) by 549 days.

(21) Appl. No.: 12/809,797

(22) PCT Filed: Dec. 2, 2008

(86) PCT No.: PCT/EP2008/066649

§ 371 (c)(1),
(2), (4) Date: Jul. 15, 2010

(87) PCT Pub. No.: WO2009/080451

PCT Pub. Date: Jul. 2, 2009

(65) Prior Publication Data

US 2010/0270847 A1 Oct. 28, 2010

(30) Foreign Application Priority Data

Dec. 21, 2007 (DE) ..... 20 2007 018 096 U

(51) Int. Cl.
*A47C 7/00* (2006.01)

(52) U.S. Cl.
USPC ..... 297/440.22; 297/336; 296/65.03

(58) Field of Classification Search
USPC ..... 297/440.22, 336; 296/65.03; 248/503.1
See application file for complete search history.

(56) References Cited

U.S. PATENT DOCUMENTS 3,915,493 A * 10/1975 Brown ..... 296/63
4,365,840 A * 12/1982 Kehl et al. ..... 297/440.2
4,759,580 A * 7/1988 Berklich et al. ..... 296/65.03
4,773,693 A * 9/1988 Premji et al. ..... 296/65.03
4,836,597 A * 6/1989 Izumida ..... 296/63
5,338,096 A * 8/1994 Huang ..... 297/243
5,443,239 A * 8/1995 Laporte ..... 248/503.1
5,558,260 A * 9/1996 Reichert ..... 224/413
5,567,008 A * 10/1996 Cone, II ..... 297/256.16
5,667,232 A * 9/1997 Gogan et al. ..... 280/202
5,931,360 A * 8/1999 Reichert ..... 224/413

(Continued)

FOREIGN PATENT DOCUMENTS

DE G8530363.1 U1 3/1986
DE 29811414 U1 12/1998

(Continued)

OTHER PUBLICATIONS

English Translation of the International Preliminary Report on Patentability from corresponding Patent Cooperation Treaty Patent Application No. PCT/EP2008/066649 mailed Aug. 19, 2010.

(Continued)

*Primary Examiner* — David E Allred

(74) *Attorney, Agent, or Firm* — Gardner, Linn, Burkhart & Flory, LLP

(57) ABSTRACT

The invention relates to a piece of furniture comprising a seat portion and a supporting substructure, wherein an apparatus for removably connecting the seat portion to the substructure is provided, the apparatus comprising at least one lever that can be moved between a position that locks the seat portion to the substructure and a release position, the lever being located at the substructure or seat portion and being provided with a bracket that forms an undercut, said bracket enclosing a pin at the seat portion or at the substructure in the locking position.

22 Claims, 4 Drawing Sheets

(56) References Cited

U.S. PATENT DOCUMENTS

| | | | | |
|---|---|---|---|---|
| 5,931,529 | A * | 8/1999 | LaPointe et al. | 297/248 |
| 6,129,405 | A * | 10/2000 | Miyahara et al. | 296/65.11 |
| 6,227,595 | B1 * | 5/2001 | Hamelin et al. | 296/65.03 |
| 6,318,807 | B1 * | 11/2001 | Perego | 297/440.22 |
| 6,443,344 | B1 * | 9/2002 | Nicosia et al. | 224/413 |
| 6,547,300 | B2 * | 4/2003 | Watanabe et al. | 296/37.3 |
| 6,609,745 | B2 * | 8/2003 | Miyahara et al. | 296/65.11 |
| 6,648,393 | B1 * | 11/2003 | Milnar et al. | 296/65.11 |
| 6,983,526 | B2 * | 1/2006 | Duffy et al. | 29/514 |
| RE39,101 | E * | 5/2006 | Miyahara et al. | 296/65.11 |
| 7,175,220 | B2 * | 2/2007 | Kashiwagi et al. | 296/65.03 |
| 7,213,881 | B2 * | 5/2007 | Kim et al. | 297/336 |
| 7,284,796 | B2 * | 10/2007 | Snelson | 297/230.1 |
| 7,320,500 | B2 * | 1/2008 | Mascull | 297/256.16 |
| 7,484,800 | B2 * | 2/2009 | Duffy et al. | 297/253 |
| 7,484,801 | B2 * | 2/2009 | Kassai et al. | 297/256.16 |
| 7,578,536 | B2 * | 8/2009 | Yajima et al. | 296/65.03 |
| 8,016,354 | B2 * | 9/2011 | Veluswamy et al. | 297/320 |
| 8,308,229 | B2 * | 11/2012 | Galley | 297/130 |
| 2002/0017814 | A1 * | 2/2002 | Niederman et al. | 297/440.16 |
| 2002/0093235 | A1 * | 7/2002 | Niederman et al. | 297/440.1 |
| 2004/0095009 | A1 * | 5/2004 | Fisher et al. | 297/440.2 |
| 2005/0082894 | A1 | 4/2005 | Chi | |
| 2006/0028044 | A1 * | 2/2006 | Oishi et al. | 296/65.03 |
| 2007/0013204 | A1 * | 1/2007 | Yajima et al. | 296/65.03 |
| 2007/0120410 | A1 | 5/2007 | Wiecek | |
| 2012/0241584 | A1 * | 9/2012 | McLeod et al. | 248/503.1 |
| 2013/0047333 | A1 * | 2/2013 | Wieland et al. | 5/3 |

FOREIGN PATENT DOCUMENTS

| | | | |
|---|---|---|---|
| DE | 202005014571 | U1 | 12/2005 |
| DE | 202007009765 | U1 | 11/2007 |
| GB | 2120540 | A * | 12/1983 |

OTHER PUBLICATIONS

International Search Report and Written Opinion of the International Searching Authority from corresponding Patent Cooperation Treaty (PCT) Application No. PCT/EP2008/066649, mailed Mar. 18, 2009.

* cited by examiner

FURNITURE

BACKGROUND OF THE INVENTION

The invention relates to a piece of furniture having a seat portion and a supporting substructure.

Pieces of furniture, such as armchairs or sofas, typically have an upholstered seat portion for actually sitting on as well as a substructure, e.g., a supporting base in the case of armchairs or a supporting traverse in the case of sofas, to which the seat portion is attached and which serves as a framework.

This substructure, also referred to as a concealed framework for a piece of furniture or upholstered item, also refers to the framework or frame which typically is substantially or completely covered by the covering upholstery. Thus, concealed frameworks do not generally impact upon the appearance of the material. However, to some extent, it is possible that parts of the concealed framework may be visible, such as the base or panels.

It is conventional for the seat portion(s) to be fixedly screwed or welded to the respective substructure during production; only the seat cushions themselves are fitted in such a manner as to be removable. However the substructure, e.g., the supporting base or the supporting traverse, has a considerable weight owing to the mechanical loads acting upon it and its function as a support. The furniture is also relatively large in size owing to the substructure, and the piece of furniture is thus unwieldy.

The weight and size create problems when transporting the furniture to customers. It is not easy to move, for example, a complete sofa via a staircase. Also, when transporting the unfinished furniture from the manufacturer of the supporting portions to the upholsterer, previously the base and traverse also had to be transported with it. This is unfavourable since these portions are obviously not required during upholstering and may possibly even complicate the upholstering process itself. However, it is not readily possible to connect the supporting base or traverses only after upholstering since the upholstery could be damaged thereby.

Omitting a traverse and/or using smaller units is also not a satisfactory solution since as of yet the units cannot be connected together satisfactorily in order to prevent, e.g., the parts coming apart. Assembling the portions on site is also not practical since correspondingly trained and suitable personnel have to be available for this job, which is not always the case.

SUMMARY OF THE INVENTION

The present invention provides a piece of furniture by means of which the above problems can be counteracted.

A piece of furniture, according to an aspect of the invention, includes a seat portion and a supporting substructure. A device is provided for releasably connecting the seat portion to the substructure. The device includes at least one lever and a pin, wherein the lever can be moved between a locking position locking the seat portion with the substructure and an unlocked position. The lever is disposed on one of the substructure or seat portion and the pin is located on the other of the substructure or seat portion. The lever includes a bracket which forms an undercut and engages around the pin in the locking position.

By virtue of the fact that a device for releasably connecting the seat portion to the substructure is provided, it is possible to handle, transport, etc., the seat portion and the substructure separately and to assemble them simply on site by way of a simple "fitting-together" process.

The device may include at least one lever which can be moved between a position locking the seat portion with the substructure and a release position. This lever is thus used to lock the two portions after they have been fitted together and can possibly have a latching functionality. The lever may be disposed on the substructure (or seat portion) and provided with a bracket which forms an undercut and engages around a pin on the seat portion (or substructure) in the locking position. Any reference made herein to one lever, etc., is intended to cover several levers, etc. Reference is made in particular to armchairs and sofas, but it is also feasible to use the invention in other pieces of furniture. In order to ensure or maintain the locking arrangement, the lever may be spring-influenced in the direction of the locking position.

Furthermore, the device can comprise at least one plate on the substructure or seat portion which is provided with an undercut, a pin provided on the seat portion or on the substructure engaging into this undercut. In particular, in this case, the lever may be articulated on the plate and cooperates therewith.

In order to provide the spring-influencing arrangement, the plate and the lever may be provided with attachment lugs for a spring. The attachment lugs and the articulation axis of the lever can be arranged such that they can be aligned (by pivoting the lever) so that the lever remains in the unlocked position since the forces of the spring thus have no effect. This facilitates the assembly of the seat portion with the substructure. Furthermore, the plate may include an open recess in which the pin lies in the locked position, wherein the bracket of the lever engages around the pin in that location.

Furthermore, if a protrusion is provided on the lever, such protrusion may be disposed such that it lies in the lower region of the recess when the lever is in the unlocked position. If, for example, the pins of the seat portion are inserted into the plate, one of them presses onto the protrusion within the recess and moves the lever from the unlocked assembly position described above and the lever clicks into place under spring force and locks the device.

Thus, the device keeps the two portions (seat portion and substructure) locked together. In order to release the locking arrangement, the lever is thus "turned back" into the described position against the spring force, for which purpose this lever may be provided with an elongate handle which is approximately opposite the bracket (relative to the axis of rotation). The undercut and the pin, together with the lever, the pin and the recess, are formed and disposed so as to fix the seat portion with respect to the substructure. In addition, the plate can be provided with bent insertion aids above the recess and the undercut in order to simplify the fitting-together process.

In order to protect the bracket or lever from extremely large forces, the plate may be provided with a bent portion in the region of the opening, the lever being disposed beneath the bent portion in the locked position so that its tendency to snap away under tension is counteracted. Furthermore, the plate may be provided with a further bent portion which provides a bearing surface for the seat portion (or the substructure) and can be formed as a section bent out from the plate.

BRIEF DESCRIPTION OF THE DRAWINGS

Further details, features and advantages of the invention can be seen from the following description of an exemplified embodiment with the aid of the drawing, in which.

DESCRIPTION OF THE PREFERRED EMBODIMENT

Referring now to an embodiment of the drawings, and the illustrative embodiments depicted therein, a furniture item, such as a reclining armchair 1 having a seat portion 2 and a base 3 is illustrated in the figures as an example of a piece of furniture having a seat portion and a substructure releasably connected thereto in accordance with the invention.

Figure 1:
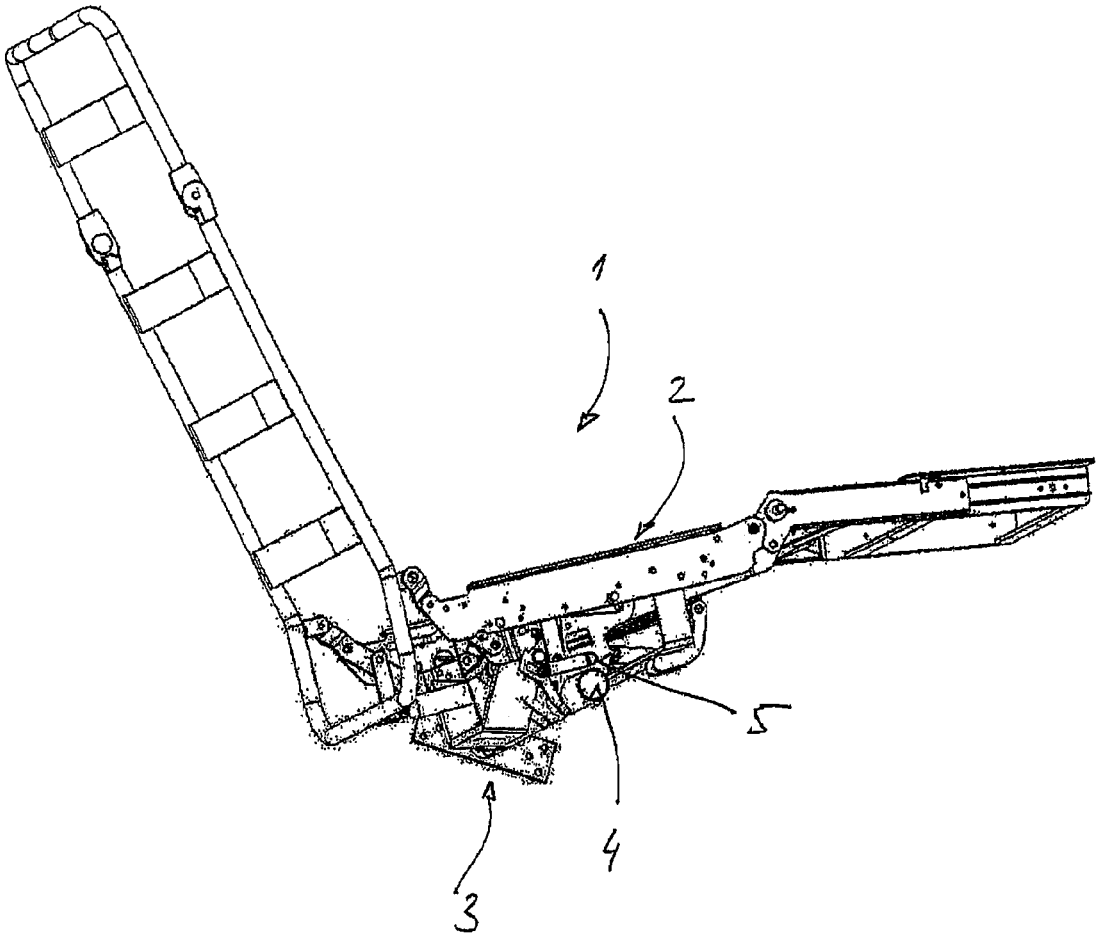
FIG. 1 shows a perspective view of an armchair having a base releasably attached to the seat portion.
Figure 2:
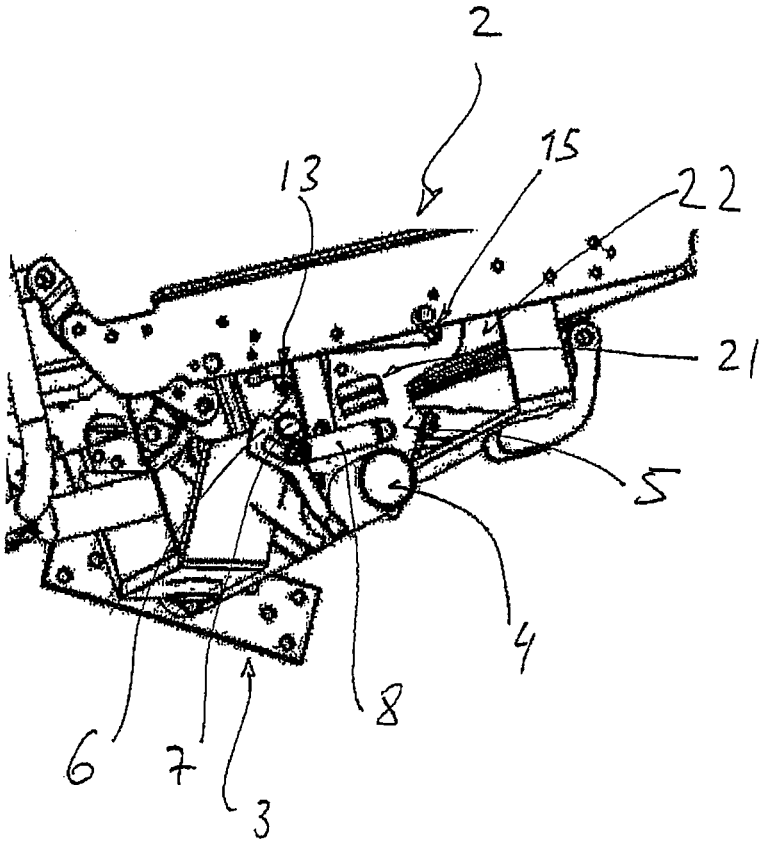
FIG. 2 shows an enlarged section from FIG. 1 in the region of the connection of the seat portion to the base.
Figure 3:
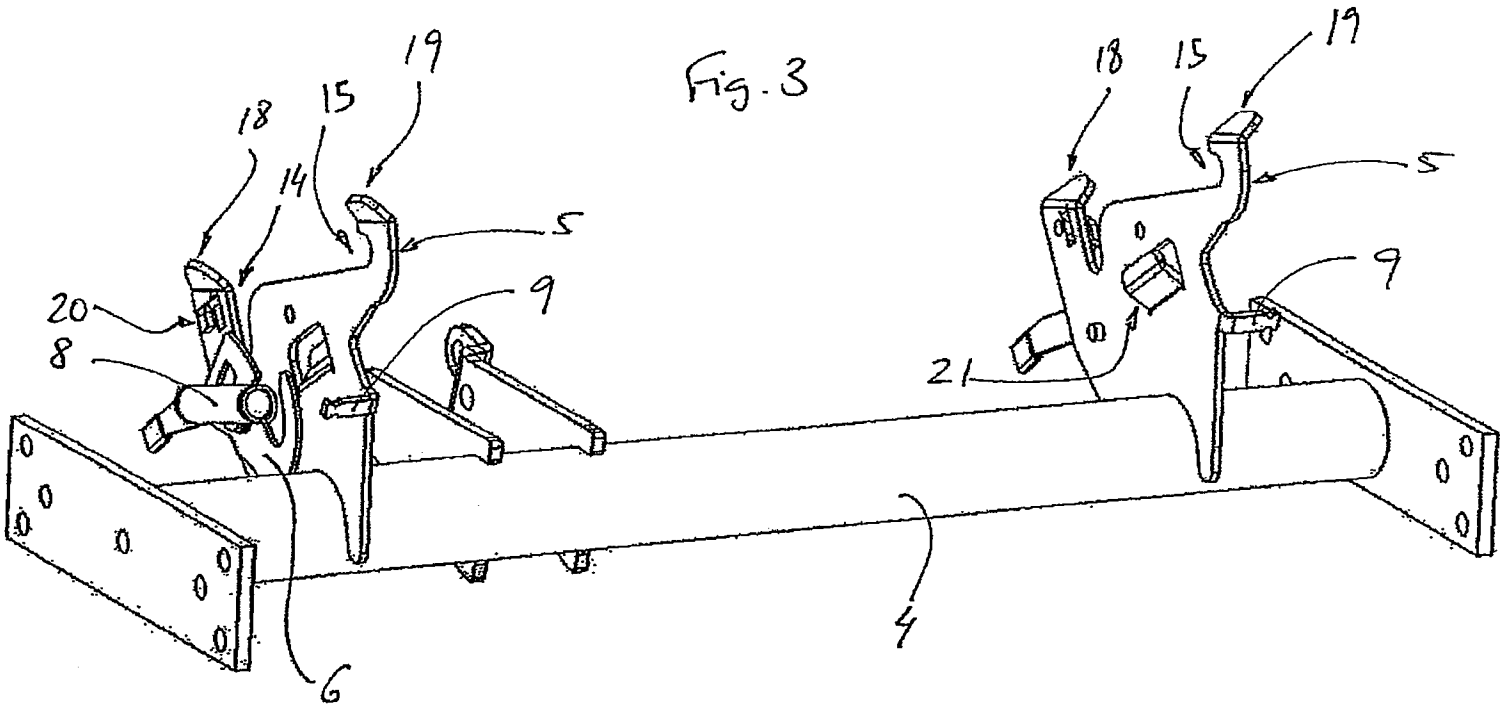
FIG. 3 shows parts of the connection to the base in an unlocked position.

Only the upper region of the base 3 is illustrated, in which a cross tube 4 is provided for lateral portions. Likewise, a plate 5 is welded to the cross tube 4 of the base 3 on each side of the armchair 1. A lever 6 is, in turn, articulated on each plate 5 and can be rotated about the axis of rotation 7 between a position locking the seat portion 2 with the base 3 (illustrated in FIG. 4) and a release position (illustrated in FIG. 3).

Figure 4:
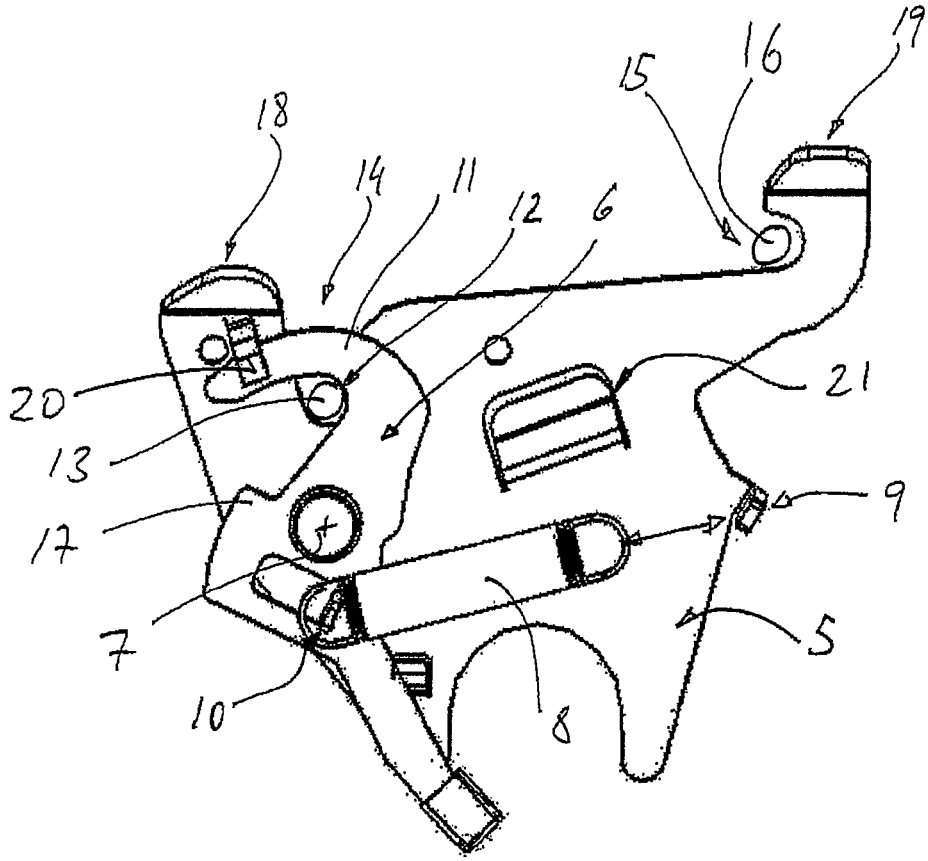
FIG. 4 shows parts of the connection of FIG. 3 in a locked position.

The lever 6 is spring-influenced or tensioned by means of a spring 8 in the direction of the locking position (as illustrated by the arrow in FIG. 4). The plate 5 and the lever 6 are each provided with attachment lugs 9, 10 for spring 8. The attachment lugs 9, 10 and the axis of rotation 7 are disposed such that they can be aligned so that the lever 6 remains in the unlocked position since the spring force is "cancelled out" when the attachment lugs 9, 10 are disposed on opposite sides of the axis of rotation.

The lever 6 is provided with a bracket 11 which forms an undercut 12 and engages around a pin 13 of the seat portion 2 in the locking position. The plate 5 comprises an open recess 14 in which the pin 13 lies in the locked position, wherein the bracket 11 of the lever 6 engages around the pin in that location. Furthermore, the plate 5 comprises an undercut 15, and a further pin 16 is provided on the seat portion 3 engaging into this undercut. In addition, a protrusion 17 is provided on the lever 6, which protrusion is disposed such that it lies in the lower region of the recess 14 when the lever 6 is in the unlocked position.

When the seat portion 2 is fitted together with the base 3, the undercut 15 and the pin 16, together with the lever 6, the pin 13 and the recess 124, fix the seat portion 2 with respect to the base 3. The lever 6 thus assumes the locking functionality. In order to simplify the fitting-together process, the plate 5 is provided with bent insertion aids 18, 19 above the recess 14 and the undercut 15. The plate 5 is provided with a bent portion 20 in the region of the opening of the recess 12, the lever 6 being disposed beneath the bent portion in the locked position. In addition, the plate 5 is provided with a further bent portion 21 which provides a bearing surface for a metal plate 22 of the seat portion 2.

The fitting-together process proceeds as follows:

Firstly, the lever 6 is moved into the unlocked position by rotating about the axis 7 so that the attachment lugs 9, 10 of the spring 8 lie on diagonally opposite sides of the axis. The force of the spring 8 thus does not effect rotation of the lever 6. Then, with the aid of the insertion aids 18, 19 on the respective top sides of the plates 5, the front pins 16 of the seat portion 2 are inserted into the undercuts 15 and moved thereagainst.

Subsequently, the rear pins 13 of the seat portion 2 are inserted into the recesses 12 of the plates 5 and the respective protrusion 17 pushes the unlocked lever 6 downwards. Lever 6 is now rotated backwards with the bracket 11 about the axis 7 from the unlocked position by the currently active force of the spring 8, since the attachment lugs 9, 10 are now no longer diagonally opposite each other. In this manner, the bracket 11 locks the pin 13 in the recess 12 (FIG. 4).

Changes and modifications in the specifically described embodiments can be carried out without departing from the principles of the invention which is intended to be limited only by the scope of the appended claims, as interpreted according to the principles of patent law including the doctrine of equivalents.

LIST OF REFERENCE NUMERALS

1 Armchair
2 Seat portion
3 Base
4 Cross tube
5 Plate
6 Lever
7 Axis of rotation
8 Spring
9 Attachment lug
10 Attachment lug
11 Bracket
12 Undercut
13 Pin
14 Recess
15 Undercut
16 Pin
17 Protrusion
17 Protrusion
18 Insertion aid
19 Insertion aid
20 Bent portion
21 Bent portion
22 Metal plate

The invention claimed is:

1. Piece of furniture comprising:

a sofa or an armchair;

said sofa or armchair having a seat portion and a base comprising a cross tube extending substantially completely across from a first lateral side to a second lateral side of said sofa or armchair, said base supporting a load placed on said seat portion and providing a framework adapted for elevating said base above a lowest portion of said base;

a device for releasably connecting the seat portion to said base, wherein said seat portion and said base can be separated for shipment and assembled by applying a relative motion between said seat portion and said base;

wherein said device comprises at least one lever and a pin, wherein said lever can be moved between a locking position locking the seat portion with the base and an unlocked position;

wherein said lever is supported by a plate fixed to and extending generally perpendicularly upward from said cross tube, and said pin is located on said seat portion, wherein said lever includes a bracket which forms an undercut and engages around said pin in the locking position.

2. Piece of furniture as claimed in claim 1, wherein said lever is spring-influenced in the direction of the locking position.

3. Piece of furniture as claimed in claim 1, wherein said device comprises another pin on said seat portion, said plate comprising an undercut selectively engaging said another pin.

4. Piece of furniture as claimed in claim 3, wherein said lever is articulated on said plate.

5. Piece of furniture as claimed in claim 3, including attachment lugs on said plate and said lever, said attachment lugs for attaching a spring.

6. Piece of furniture as claimed in claim 5, wherein said lever rotates about an axis of rotation and wherein said attachment lugs and said axis of rotation are arranged such that they can be aligned so that said lever can remain in the unlocked position.

7. Piece of furniture as claimed in claim 3, wherein said plate defines an open recess in which said pin lies in the locked position and said bracket of said lever engages around said pin in said open recess.

8. Piece of furniture as claimed in claim 7, including a protrusion on said lever, said protrusion being disposed to occupy a lower region of said recess when said lever is in the unlocked position.

9. Piece of furniture as claimed in claim 8, wherein said plate defines another undercut in which said another pin selectively lies, wherein said another undercut and said another pin, together with said lever, said pin and said recess, are formed and disposed so as to fix the seat portion with the base.

10. Piece of furniture as claimed in claim 9, wherein said plate is provided with bent insertion aids respectively above said recess and said another undercut.

11. Piece of furniture as claimed in claim 7, wherein said plate is provided with a bent portion in the region of said open recess, said lever being disposed beneath said bent portion in the locked position.

12. Piece of furniture as claimed in claim 11, wherein said plate is provided with a further bent portion which provides a bearing surface for the seat portion.

13. Piece of furniture as claimed in claim 2, wherein said device comprises another pin on said seat portion, said plate comprising an undercut selectively engaging said another pin.

14. Piece of furniture as claimed in claim 13, wherein said lever is articulated on said plate.

15. Piece of furniture as claimed in claim 13, including attachment lugs on said plate and said lever, said attachment lugs for attaching a spring.

16. Piece of furniture as claimed in claim 15, wherein said lever rotates about an axis of rotation and wherein said attachment lugs and said axis of rotation are arranged such that they can be aligned so that said lever can remain in the unlocked position.

17. Piece of furniture as claimed in claim 13, wherein said plate defines an open recess in which said pin lies in the locked position and said bracket of said lever engages around said pin in said open recess.

18. Piece of furniture as claimed in claim 17, including a protrusion on said lever, said protrusion being disposed to occupy a lower region of said recess when said lever is in the unlocked position.

19. Piece of furniture as claimed in claim 18, wherein said plate defines another undercut in which said another pin selectively lies, wherein said another undercut and said another pin, together with said lever, said pin and said recess, are formed and disposed so as to fix the seat portion with the base.

20. Piece of furniture as claimed in claim 17, wherein said plate is provided with bent insertion aids respectively above said recess and said another undercut.

21. Piece of furniture as claimed in claim 17, wherein said plate is provided with a bent portion in the region of said open recess, said lever being disposed beneath said bent portion in the locked position.

22. Piece of furniture as claimed in claim 3, wherein said plate is provided with a further bent portion which provides a bearing surface for the seat portion.

* * * * *